US005112798A

United States Patent [19]

Miyauchi

[11] Patent Number: 5,112,798

[45] Date of Patent: May 12, 1992

[54] HEAT-SENSITIVE RECORDING SHEET

[75] Inventor: Masahiro Miyauchi, Takasago, Japan

[73] Assignee: Mitsubishi Paper Mills Limited, Tokyo, Japan

[21] Appl. No.: 571,999

[22] Filed: Aug. 24, 1990

[30] Foreign Application Priority Data

Oct. 13, 1989 [JP] Japan ..... 1-267097

[51] Int. Cl.[5] ..... B41M 5/30

[52] U.S. Cl. ..... 503/209; 503/208; 503/217; 503/225

[58] Field of Search ..... 503/208, 209, 216, 217, 503/221, 225

[56] References Cited

U.S. PATENT DOCUMENTS 4,682,193 7/1987 Iwakura et al. ..... 503/216

FOREIGN PATENT DOCUMENTS 3837889 5/1989 Japan ..... 503/208

*Primary Examiner*—Pamela R. Schwartz

*Attorney, Agent, or Firm*—Cushman, Darby & Cushman

[57] ABSTRACT

The present invention relates to a heat-sensitive recording sheet which comprises a support, an undercoat layer provided on said support and a heat-sensitive color forming layer provided on said undercoat layer, said heat-sensitive color fomring layer containing a colorless or palely colored dye precursor, a developer which reacts with said dye precursor upon application of heat to cause said dye precursor to form color, N-methylolbehenic acid amide, and at least one sensitivity enhancing agent. This heat-sensitive recording sheet is excellent in heat responsiveness, high in sensitivity and superior in mechanical matching properties.

4 Claims, No Drawings

HEAT-SENSITIVE RECORDING SHEET

The present invention relates to a heat-sensitive recording sheet excellent in heat responsiveness, high in sensitivity and superior in mechanical matching.

Heat-sensitive recording sheet generally comprises a support and, provided thereon, a heat-sensitive recording layer mainly composed of an electron-donating, normally colorless or light-colored dye precursor and an electron-accepting, developer and, if necessary, a sensitizer. Upon application of heat to the heat-sensitive recording layer by a thermal head, hot pen, laser beam, and the like, the dye precursor reacts with the developer to form images. These are disclosed in Japanese Patent Kokoku (Post Exam. Publication) Nos. 43-4160 and 45-14039.

These heat-sensitive recording sheets have such merits that record can be obtained by relatively simple devices and thus maintenance is easy and no noise is generated. Therefore, they are widely used for recorders for instrumentation, facsimile, printer, computer terminal equipment, labeling, ticket vending machines, and the like. Demand for heat-sensitive recording system has been much increased especially in the field of facsimile.

Recently, decrease in applied energy is conspicuous due to increase in printing speed and thus it has been desired to enhance sensitivity of heat-sensitive recording sheet, namely, to attain formation of color in high density using low heat energy. Furthermore, necessity to reduce friction of the surface of heat-sensitive recording sheet is increased for power reduction of torque motor for feeding of sheets which is required due to miniaturization of devices.

In general, for enhancement of sensitivity, it has been proposed to provide an undercoat layer mainly composed of oil absorbing pigment or polymer compound between support and heat-sensitive color forming layer or to use developer or dye precursor of low melting point (Japanese Patent Kokoku (Post Exam. Publication) No. 52-140483) or to use a material having a melting point of about 80°–140° C. and strong chemical affinity with dye precursor or developer, namely, a sensitivity improver (Japanese Patent Kokai (Laid-Open) Nos. 53-39139 and 54-139740).

It has been well known that addition of wax or the like is effective for reduction of frictional resistance.

However, use of the above developer or dye precursor of low melting point or sensitivity improver in combination with wax causes adverse effect on enhancement of sensitivity because wax makes no contribution to improvement of color sensitivity and rather takes heat energy for its own melting. Besides, wax melts on thermal head and adheres to and deposits on the head during being cooled and solidified with movement of recording sheet and thus, tailings are produced. Furthermore, the heat meltable component is molten and retained between thermal head and recording sheet, which often causes noise generated owing to forced peeling for feeding of sheet and omission of images, namely, sticking. Therefore, it is impossible to add wax in such an amount as providing sufficient effect to improve sensitivity.

Under the circumstances, various researches have been made on higher fatty acid amides having both the sensitivity improving effect and the frictional resistance reducing effect. However, single use thereof is insufficient in sensitivity improving effect and many of them cause sticking and heat fogging.

Therefore, at present, there has not yet been obtained any heat-sensitive recording sheet which satisfies both the high sensitivity and mechanical matching.

The object of the present invention is to provide a heat-sensitive recording sheet which is excellent in heat responsiveness, high in sensitivity and color density and good in mechanical matching properties such as small surface friction and less adhesion of tailings and sticking.

The present invention relates to a heat-sensitive recording sheet comprising a support, an undercoat layer provided on the support and a heat-sensitive color forming layer provided on the undercoat layer, said heat-sensitive color forming layer containing a colorless or light-colored dye precursor, a developer which reacts with the dye precursor upon application of heat to bring about color formation of the dye precursor, N-methylolbehenic acid amide, and at least one sensitivity enhancing agent.

When N-methylolbehenic acid amide is used alone, sensitivity enhancing effect is unsatisfactory while when it is used in combination with the sensitivity enhancing agent, remarkable sensitivity enhancing effect can also be exhibited.

As the sensitivity enhancing agent, there may be used those which are normally used, such as esters of benzoic acid or terephthalic acid, esters of naphthalenesulfonic acid, naphthyl ether derivatives, anthryl ether derivatives, aliphatic ethers, phenanthrene and fluorene. Preferably, one or more compounds selected from 2-benzyloxynaphthalene, p-benzylbiphenyl, di-p-chlorobenzyl oxalate, and di-p-methylbenzyl oxalate are used to obtain higher effect.

More preferably, 3-dibutylamino-6-methyl-7-anilinofluoran as the dye precursor and 4,4'-isopropylidenediphenol as developer are contained as constituting elements.

Amount of N-methylolbehenic acid amide to be added is at least 2% by weight, desirably 5–80% by weight based on the weight of the developer and amount of sensitivity enhancing agent added together is at least 10% by weight, preferably 50–200% by weight based on the weight of the developer, whereby the object of the present invention is effectively attained.

The principal components used in the present invention will be explained in detail below, it being understood that the invention is not intended to be limited to the explanation as far as it does not exceed the scope of the present invention.

Typical examples of dye precursors which form color by phenolic substances or organic acids are enumerated below.

(1) Crystal Violet Lactone
(2) 3-Indolino-3-p-dimethylaminophenyl-6-dimethylaminophthalide
(3) 3-Diethylamino-7-chlorofluoran
(4) 3-Diethylamino-7-cyclohexylaminofluoran
(5) 3-Diethylamino-5-methyl-7-t-butylfluoran
(6) 3-Diethylamino-6-methyl-7-anilinofluoran
(7) 3-Diethylamino-6-methyl-7-p-butylanilinofluoran
(8) 2-(N-phenyl-N-ethyl)aminofluoran
(9) 3-Diethylamino-7-dibenzylaminofluoran
(10) 3-Cyclohexylamino-6-chlorofluoran
(11) 3-Diethylamino-6-methyl-7-xylidinofluoran
(12) 2-Anilino-3-methyl-6-(N-ethyl-p-toluidino)fluoran
(13) 3-Pyrrolidino-6-methyl-7-anilinofluoran

(14) 3-Pyrrolidino-7-cyclohexylaminofluoran
(15) 3-Piperidino-6-methyl-7-toluidinofluoran
(16) 3-Piperidino-6-methyl-7-anilinofluoran
(17) 3-(N-methylcyclohexylamino)-6-methyl-7-anilinofluoran
(18) 3-Diethylamino-7-(m-trifluoromethylanilino)fluoran
(19) 3-Diethylamino-6-methyl-7-chlorofluoran
(20) 3-Dibutylamino-6-methyl-7-anilinofluoran
(21) 3-(N-ethyl-N-isoamyl)amino-6-methyl-7-anilinofluoran Typical examples of phenolic substances or organic acids (developer) are shown below.

(1) 4,4'-Isopropylidenediphenol
(2) 4,4'-Isopropylidenebis(2-chlorophenol)
(3) 4,4'-Isopropylidenebis(2-tert-butylphenol)
(4) 4,4'-sec-Butylidenediphenol
(5) 4,4'-(1-Methyl-n-hexylidene)diphenol
(6) 4-Phenylphenol
(7) 4-Hydroxydiphenoxide
(8) Methyl-4-hydroxybenzoate
(9) Phenyl-4-hydroxybenzoate
(10) 4-Hydroxyacetophenone
(11) Salicylic acid anilide
(12) 4,4'-Cyclohexylidenediphenol
(13) 4,4'-Cyclohexylidenebis(2-methylphenol)
(14) 4,4'-Benzylidenediphenol
(15) 4,4'-thiobis(6-tert-butyl-3-methylphenol)
(16) 4,4'-Isopropylidenebis(2-methylphenol)
(17) 4,4'-Ethylenebis(2-methylphenol)
(18) 4,4'-Cyclohexylidenebis(2-isopropylphenol)
(19) 2,2'-Dihydroxydiphenyl
(20) 2,2'-Methylenebis(4-chlorophenol)
(21) 2,2'-Methylenebis(4-methyl-6-t-butylphenol)
(22) 1,1'-bis(4-Hydroxyphenol)-cyclohexane
(23) 2,2-bis(4'-Hydroxyphenyl)propane
(24) Novolak type phenolic resin
(25) Halogenated novolak type phenolic resin
(26) α-Naphthol
(27) β-Naphthol
(28) 3,5-di-t-Butylsalicylic acid
(29) 3,5-di-α-Methylbenzylsalicylic acid
(30) 3-Methyl-5-t-butylsalicylic acid
(31) Phthalic acid monoanilide p-ethoxybenzoic acid
(32) bis(4-Hydroxyphenyl)sulfone
(33) 4-Hydroxy-4'-isopropyloxydiphenylsulfone
(34) bis(3-Allyl-4-hydroxyphenyl)sulfone
(35) p-Benzyloxybenzoic acid
(36) Benzyl p-hydroxybenzoate The heat-sensitive recording sheet of the present invention can be obtained by the following method. That is, phenolic substance or organic acid and dye precursor which forms color with said phenolic substance or organic acid are separately or simultaneously pulverized to fine particles by a grinder and dispersed and mixed with binder, pigment and the like and, if necessary, various additives are added to the mixture to prepare a coating liquid.

As the binder, there may be used, for example, water-soluble binders such as starches, hydroxyethyl cellulose, methyl cellulose, poly(vinyl alcohol), styrene-maleic anhydride copolymer, styrene-butadiene copolymer, polyacrylamide type copolymer, carboxymethyl cellulose, gum arabic, and casein; and latexes such as styrene-butadiene latex.

As the pigment, mention may be made of, for example, diatomaceous earth, talc, kaolin, calcined kaolin, calcium carbonate, magnesium carbonate, titanium oxide, zinc oxide, silicon oxide, aluminium hydroxide, and urea-formalin resin.

Furthermore, within ranges of amounts which give no adverse effect on characteristics, there may be used higher fatty acid metal salts such as zinc stearate and calcium stearate; waxes such as paraffin, paraffin oxide, polyethylene, polyethylene oxide and castor-wax, wetting agents such as dioctyl sulfosuccinate, ultraviolet absorbers such as benzophenone type and benzotriazole type absorbers, surface active agents, and fluorescent dyes.

As support of heat-sensitive recording sheet of the present invention, paper is mainly used, but various nonwoven fabrics, plastic films, synthetic papers, metallic foils, and composite sheets comprising combination of them may also be used.

Undercoat layer in the present invention preferably comprises white pigments such as calcined kaolin, kaolin, natural silica, synthetic silica, aluminium hydroxide, calcium carbonate, calcium oxide, magnesium carbonate, magnesium oxide, urea-formaldehyde filler, and cellulose filler.

As binders, mention may be made of, for example, styrene-butadiene rubber latex, acrylic resin emulsion, poly(vinyl alcohol), carboxymethyl cellulose, hydroxyethyl cellulose, styrene-malelic anhydride copolymer, starch, starch derivative, diisobutylenemaleic anhydride copolymer, casein, and gelatin. Besides these components, dispersing agents, defoaming agents, lubricants and the like which are used for general coat papers may be used.

Effect of N-methylolbehenic acid amide has not been elucidated on its properties, but the reasons for it being able to attain effective enhancement of sensitivity and giving no adverse effect such as fogging with heat are considered that it has a melting point sharp between 110°-130° C. with a center at about 120° C. as compared with other higher fatty acid amides. N-methylolstearic acid amide analogous to N-methylolbehenic acid amide has nearly the same effect to improve sensitivity, but has problems in fogging with heat, formation of tailings and sticking because it has an endothermic peak at lower than 100° C.

Amides having a melting point of lower than 100° C. causes especially conspicuous fogging with heat and those which have a melting point of higher than 140° C. does not cause fogging with heat, but poor in effect to improve sensitivity.

That is, a heat-sensitive recording sheet comprising a support and an undercoat layer and a heat-sensitive color forming layer provided on the support in this order which is excellent in heat responsiveness, forms color with high sensitivity and less in formation of tailings, sticking and surface friction, namely, good in mechanical matching properties can be obtained when the heat-sensitive color forming layer contains a colorless or light-colored dye precursor and a developer which reacts with the dye precursor upon application of heat to cause the dye precursor to develop color as main components and N-methylolbehenic acid amide, and furthermore, at least one sensitivity enhancing agent; preferably when the sensitivity enhancing agent used in combination with N-methylolbehenic acid amide is at least one compound selected from 2-benzyloxynaphthalene, p-benzylbiphenyl, di-p-chlorobenzyl oxalate and di-p-methylbenzyl oxalate: and more preferably, when the dye precursor is 3-dibutylamino-6-methyl-7-anilinofluoran and the developer is 4,4'-isopropylidenediphenol.

The following nonlimiting examples illustrate the present invention. The parts used in the examples are by weight.

EXAMPLE 1

| | |
|---|---|
| Liquid A: | |
| 3-Dibutylamino-6-methyl-7-aniiinofluoran | 10 parts |
| 10% Aqueous poly(vinyl alcohol) solution | 10 parts |
| Water | 30 parts |
| Liquid B: | |
| 4,4'-Isopropylidenediphenol | 10 parts |
| N-methylolbehenic acid amide | 5 parts |
| 10% Aqueous poly(vinyl alcohol) solution | 15 parts |
| Water | 45 parts |
| Liquid C: | |
| 2-Benzyloxynaphthalene | 10 parts |
| 10% Aqueous poly(vinyl alcohol) solution | 10 parts |
| Water | 30 parts |

Liquids A, B and C were separately pulverized so as to obtain particle size of 1-2 μm by a sand grinder.

Heat-sensitive coating liquid was prepared by mixing 15 parts of liquid A, 30 parts of liquid B, 25 parts of liquid C, 35 parts of 10% aqueous poly(vinyl alcohol) solution, and 10 parts of calcium carbonate with 22.5 parts of water with stirring.

Undercoating liquid was prepared by adding 150 parts of water to 100 parts of calcined kaolin (Ansilex manufactured by Engelhard Co.) and 0.5 part of sodium hexametaphosphate and dispersing them to obtain a slurry, adding 15 parts of 20% aqueous solution of phosphoric acid esterified starch (MS4600 manufactured by Nippon Shokuhin Kako K.K.) and 15 parts of latex (JSR0692 manufactured by Japan Synthetic Rubber Co., Ltd.) to the above slurry and well mixing them.

The resulting undercoating liquid was coated on a woodfree paper of 50 g/m$^2$ in basis weight at a coverage of 8 g/m$^2$ (in terms of solid content) and dried to obtain an undercoated paper. On this undercoat layer was coated the heat sensitive coating liquid prepared above at a coverage of 4.8 g/m$^2$ (in terms of solid content) and dried. Then, the heat-sensitive coat was surface treated so that the surface had a Bekk smoothness of 300-600 seconds to obtain a heat-sensitive recording sheet.

EXAMPLE 2

A heat-sensitive recording sheet was obtained in the same manner as in Example 1, except that the following liquid D was used in place of liquid C.

| | |
|---|---|
| Liquid D: | |
| Di-p-methylbenzyl oxalate | 10 parts |
| 10% Aqueous poly(vinyl alcohol) solution | 10 parts |
| Water | 30 parts |

EXAMPLE 3

A heat-sensitive recording sheet was obtained in the same manner as in Example 1, except that the following liquid E was used in place of liquid B.

| | |
|---|---|
| Liquid E: | |
| 4-Hydroxy-4'-isopropyloxydiphenylsulfone | 10 parts |
| N-methylolbehenic acid amide | 5 parts |

-continued

| | |
|---|---|
| Liquid E: | |
| 10% Aqueous poly(vinyl alcohol) solution | 15 parts |
| Water | 45 parts |

EXAMPLE 4

A heat-sensitive recording sheet was obtained in the same manner as in Example 1, except the following liquid F was used in place of liquid C.

| | |
|---|---|
| Liquid F: | |
| p-Benzylbiphenyl | 1 part |
| Di-p-methylbenzyl oxalate | 9 parts |
| 10% Aqueous poly(vinyl alcohol) solution | 10 parts |
| Water | 30 parts |

EXAMPLE 5

A heat-sensitive recording sheet was obtained in the same manner as in Example 1, except that the following liquid G was used in place of liquid A.

| | |
|---|---|
| Liquid G: | |
| 3-(N-ethyl-N-isoamyl)amino-6-methyl-7-anilinofluoran | 10 parts |
| 10% Aqueous poly(vinyl alcohol) solution | 10 parts |
| Water | 30 parts |

EXAMPLE 6

A heat-sensitive recording sheet was obtained in the same manner as in Example 1, except that dibenzyl terephthalate was used in place of 2-benzyloxynaphthalene in liquid C.

COMPARATIVE EXAMPLE 1

| | |
|---|---|
| Liquid I: | |
| 4,4'-Isopropylidenediphenol | 4 parts |
| N-methylolbehenic acid amide | 7 parts |
| 10% Aqueous poly(vinyl alcohol) solution | 11 parts |
| Water | 33 parts |

15 parts of liquid A, 55 parts of liquid I, 35 parts of 10% aqueous poly(vinyl alcohol) solution, and 10 parts of calcium carbonate were mixed with 22.5 parts of water with stirring to prepare a coating liquid.

Thereafter, in the same manner as in Example 1, a heat-sensitive recording sheet was obtained.

COMPARATIVE EXAMPLE 2

| | |
|---|---|
| Liquid J: | |
| 4,4'-Isopropylidenediphenol | 10 parts |
| 10% Aqueous poly(vinyl alcohol) solution | 10 parts |
| Water | 30 parts |

Liquid J was used in place of liquid B in Example 1. 15 parts of liquid A, 20 parts of liquid J, 35 parts of liquid C, 35 parts of 10% aqueous poly(vinyl alcohol) solution and 10 parts of calcium carbonate were mixed with 22.5 parts of water with stirring to prepare a coating liquid.

Thereafter, procedure of Example 1 was repeated to obtain a heat-sensitive recording sheet.

COMPARATIVE EXAMPLE 3

A heat-sensitive recording sheet was obtained in the same manner as in Comparative Example 2, except that liquid D was used in place of liquid C.

COMPARATIVE EXAMPLE 4

A heat-sensitive recording sheet was obtained in the same manner as in Example 1, except that behenic acid amide was used in place of N-methylolbehenic acid amide in liquid B.

COMPARATIVE EXAMPLE 5

A heat-sensitive recording sheet was obtained in the same manner as in Example 1, except that polyethylene wax was used in place of N-methylolbehenic acid amide in liquid B.

COMPARATIVE EXAMPLE 6

A heat-sensitive recording sheet was obtained in the same manner as in Example 1, except that the heat-sensitive coating liquid was coated directly on a woodfree paper of 50 g/m$^2$ in basis weight, not on undercoated paper.

The resulting heat-sensitive recording sheets were evaluated on color sensitivity, sticking and surface friction by the following test methods.

Color sensitivity

Recording was carried out at 1.6 ms with a cycle of 10 ms by heat-sensitive printing apparatus (TH-PMD2) manufactured by Ohkura Denki K.K. using a thin film head (KJT-256-8MGF1-TS) manufactured by Kyocera Co. and the resulting density was measured by Macbeth reflective densitometer. This value has correlation with high-speed facsimile sensitivity and the higher the value is, the higher the density is.

Sticking

State of sticking when reception at G3, fine mode was conducted by PANAFAX UF-22 manufactured by Matsushita Denso Co. was observed and evaluated by the following three grades.

○: Good
Δ: Somewhat bad
x: Bad (unusable)

Surface friction

Coefficient of static friction and coefficient of dynamic friction between the surface of the samples obtained above and the back side of woodfree paper used as support were measured by apparatus for measuring coefficient of friction manufactured by Tester Sangyo K.K. Contact area of sample: 60 mm×100 mm; load: 700 g; and moving speed: 1000 mm/min. The smaller the value is, the smaller the friction is.

The results are shown in the following table.

TABLE

| | Color sensitivity | Mechanical matching properties: Sticking | Coefficient of static friction | Coefficient of dynamic friction |
|---|---|---|---|---|
| Example 1 | 1.26 | ○ | 0.33 | 0.26 |
| Example 2 | 1.27 | ○ | 0.31 | 0.24 |
| Example 3 | 1.24 | ○~Δ | 0.30 | 0.24 |
| Example 4 | 1.28 | ○ | 0.31 | 0.28 |
| Example 5 | 1.24 | ○ | 0.33 | 0.28 |
| Example 6 | 1.20 | ○~Δ | 0.32 | 0.27 |
| Comparative Example 1 | 1.06 | Δ | 0.28 | 0.25 |
| Comparative Example 2 | 1.17 | x | 0.36 | 0.31 |
| Comparative Example 3 | 1.17 | Δ | 0.36 | 0.30 |
| Comparative Example 4 | 1.18 | x | 0.35 | 0.29 |
| Comparative Example 5 | 1.12 | x | 0.30 | 0.23 |
| Comparative Example 6 | 1.08 | Δ | 0.34 | 0.28 |

As shown in the above Table, heat-sensitive recording sheets comprising a support and an undercoat layer and a heat-sensitive color forming layer provided on said support in this order, said heat-sensitive color forming layer containing N-methylolbehenic acid amide and additionally at least one sensitivity enhancing agent show color formation of high sensitivity and besides is less in sticking and low in surface friction and thus has remarkably excellent mechanical matching properties.

I claim:

1. A heat-sensitive recording sheet which comprises a support, an undercoat layer provided on said support and a heat-sensitive color forming layer provided on said undercoat layer, said heat sensitive color forming layer containing a colorless or palely colored dye precursor, a developer which reacts with said dye precursor upon application of heat to cause said dye precursor to form color, N-methylolbehenic acid amide, and at least one sensitivity enhancing agent.

2. A heat-sensitive recording sheet according to claim 1, wherein the sensitivity enhancing agent is at least one compound selected from 2-benzyloxynaphthalene, p-benzylbiphenyl, di-p-chlorobenzyl oxalate, and di-p-methylbenzyl oxalate.

3. A heat-sensitive recording sheet according to claim 1 or 2, wherein the dye precursor is 3-dibutylamino-6-methyl-7-anilinofluoran and the developer is 4,4'-isopropylidenediphenol.

4. A heat-sensitive recording sheet according to claim 2, wherein the dye precursor is 3-dibutylamino-6-methyl-7-anilinofluoran and the developer is 4,4'-isopropylidenediphenol.

* * * * *